United States Patent [19]

Tada et al.

[11] Patent Number: 4,559,030

[45] Date of Patent: Dec. 17, 1985

[54] APPARATUS FOR FOLDING JACKET MATERIAL

[75] Inventors: Akira Tada, Toyonaka; Koichi Tanigawa, Kawanishi, both of Japan

[73] Assignee: O-M Limited, Osaka, Japan

[21] Appl. No.: 552,242

[22] Filed: Nov. 16, 1983

[30] Foreign Application Priority Data

Nov. 19, 1982 [JP] Japan ..... 57-204347

[51] Int. Cl.[4] ..... B31B 1/28; B31B 1/56

[52] U.S. Cl. ..... 493/252; 493/254; 493/454

[58] Field of Search ..... 72/319, 320, 388; 493/243, 250, 252, 254, 405, 413, 454

[56] References Cited

U.S. PATENT DOCUMENTS

| | | | |
|---|---|---|---|
| 2,347,902 | 5/1944 | Gaubert | 493/252 X |
| 2,837,979 | 6/1958 | Vilutus | 493/252 X |
| 3,867,829 | 2/1975 | Bock | 72/388 X |

FOREIGN PATENT DOCUMENTS

| | | | |
|---|---|---|---|
| 389665 | 2/1924 | Fed. Rep. of Germany | 493/243 |
| 625300 | 9/1961 | Italy | 72/388 |

*Primary Examiner*—E. Michael Combs

*Attorney, Agent, or Firm*—Wenderoth, Lind & Ponack

[57] ABSTRACT

An apparatus for folding a jacket material, used mainly for a magnetic cartridge, is characterized by using a folding insert, a folding bar, and a heater bar, to form the jacket material into a jacket of good external shape and high dimensional precision with a folded corner entirely free from loosening, warping, waving, swelling, etc.

3 Claims, 6 Drawing Figures

APPARATUS FOR FOLDING JACKET MATERIAL

BACKGROUND OF THE INVENTION

1. Field of the Invention

This invention relates to an apparatus for folding in two an envelope-shape jacket material for a magnetic cartridge.

2. Description of the Prior Art

In recent years, a magnetic cartridge with a magnetic disk in which voice signals, video signals, data signals, etc. are recorded and enclosed in an envelope-shape jacket has been used practically. The magnetic cartridge of this type is inserted in a floppy disk device of a computer as its magnetic disk is enclosed in a jacket so as to reproduce records by rotating the magnetic disk and by making a reproduction head contact its track.

In the conventional method of folding jacket material, a forward end of the folding bar is positioned at the end surface of the table and the folding bar is simply moved in an arc. Unfortunately, loosening, warping, waving, swelling, etc. are liable to take place at the folded corner. Also, as a heater bar is applied to such folded corner, formation of the folded corner is inaccurate, resulting in poor external shape and poor dimensional precision of the jacket.

SUMMARY OF THE INVENTION

An object of the present invention is to provide an apparatus for folding a jacket material into a jacket for a magnetic disk which is entirely free from loosening, warping, waving, swelling, etc. at its folded corner and has good external shape and high dimensional precision.

IN THE DRAWINGS

DESCRIPTION OF THE PREFERRED EMBODIMENT

Figure 1:
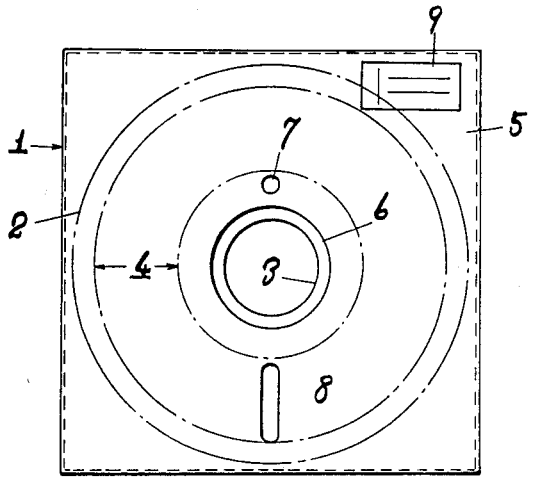
FIG. 1 is a front view of the magnetic cartridge.

In FIG. 1, a magnetic cartridge 1 comprises a magnetic disk 2 and a jacket 5 in which the magnetic disk 2 is enclosed. The magnetic disk 2 is made of film having moderate flexibility, such as polyester resin. It has an engaging hole 3 at the center thereof and a track 4 coated with a magnetic layer at both surfaces thereof for recording or storing various signals thereon. The jacket 5 is made of thermosetting resin, such as vinyl chloride, and is shaped into a substantially square envelope. A circular opening 6 slightly larger than the engaging hole 3 is bored at the central part of the jacket 5. A detecting hole 7 for the starting point of reproduction and a slot 8 through which a reproduction head makes contact are made at the upper and the lower part of the circular opening 6. A ruled paper 9 is stuck to the upper corner of the jacket.

Figure 2:
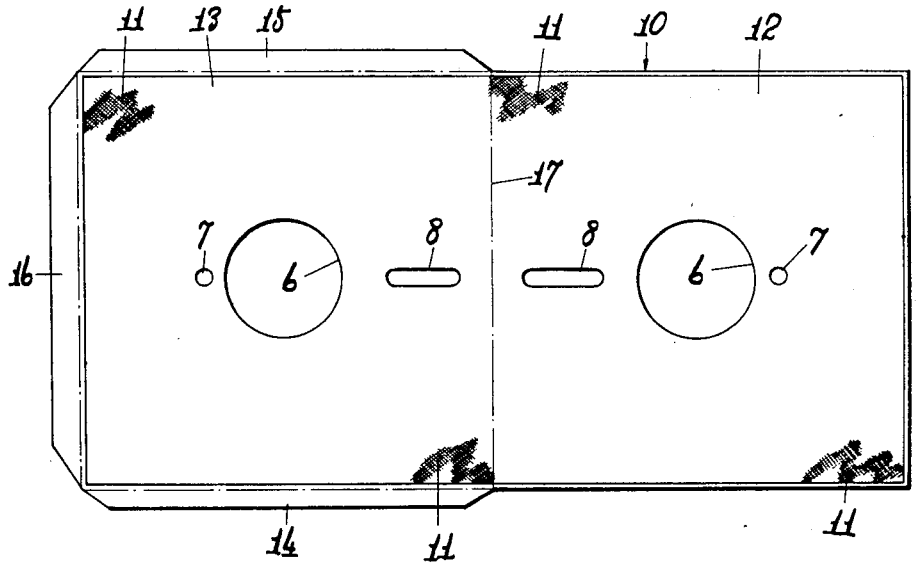
FIG. 2 is a front view of the jacket material.

As shown in FIG. 2, the jacket 5 is made of a rectangular sheet material 10 which is folded in two. This jacket material 10 is covered with a nonwoven liner 11 almost all over the surface of its one side which becomes the inside of the jacket. The circular opening 6, the detecting hole 7, and the slot 8 are made at the designated position of a right half portion 12 and a left half portion 13. Flaps 14, 15, 16 of small width are provided at the three sides of the left half portion 13. This jacket material 10 is fed into a jacket forming device, where it is folded in two at its center line 17 and the folded corner is formed into a ⊐ shape by heating. Then, the flaps 14, 15 at both sides are heat sealed to form an envelope-like jacket having the specified gap in which the magnetic disk 2 is inserted and finally the flap 16 is heat sealed. It is possible to punch the circular opening 6, the detecting hole 7, and the slot 8 after the jacket 5 is made up.

Since this magnetic cartridge 1 is inserted in a floppy disk of a computer as the magnetic disk 2 is enclosed in the jacket 5, it has such advantages that the magnetic layer of the magnetic disk 2 is free from being stuck with dust and is kept cleaned by the liner 11 while the magnetic disk 2 is turning. On the contrary, high precision is required for the external form and dimensions of the jacket 5.

The apparatus of the present invention uses a process of folding a jacket material which corresponds to the first stage of such jacket forming process. The method is characterized in that a forward end of a folding insert is projected from a front edge of the table of the jacket forming device and a jacket material is folded substantially 180° at its central part along the folding insert, as it is being rubbed by a folding bar. A heater bar is applied to the folded corner, before the folding angle of the jacket material becomes 180°, to form the folded corner in a ⊐ shape. By rubbing the jacket material with the folding bar, loosening, warping, waving, swelling, etc. at the folded corner are eliminated. By rubbing the jacket material with the folding bar while heating it with a heater bar applied to it earlier, the folded corner is formed in a ⊐ shape accurately. Thus, jackets having high precision of external form and dimensions can be produced at high efficiency. The present invention provides an apparatus which is most suitable for carrying out such method of folding jacket materials.

An embodiment of the present invention is explained below, with reference to FIG. 3.

Figure 3:
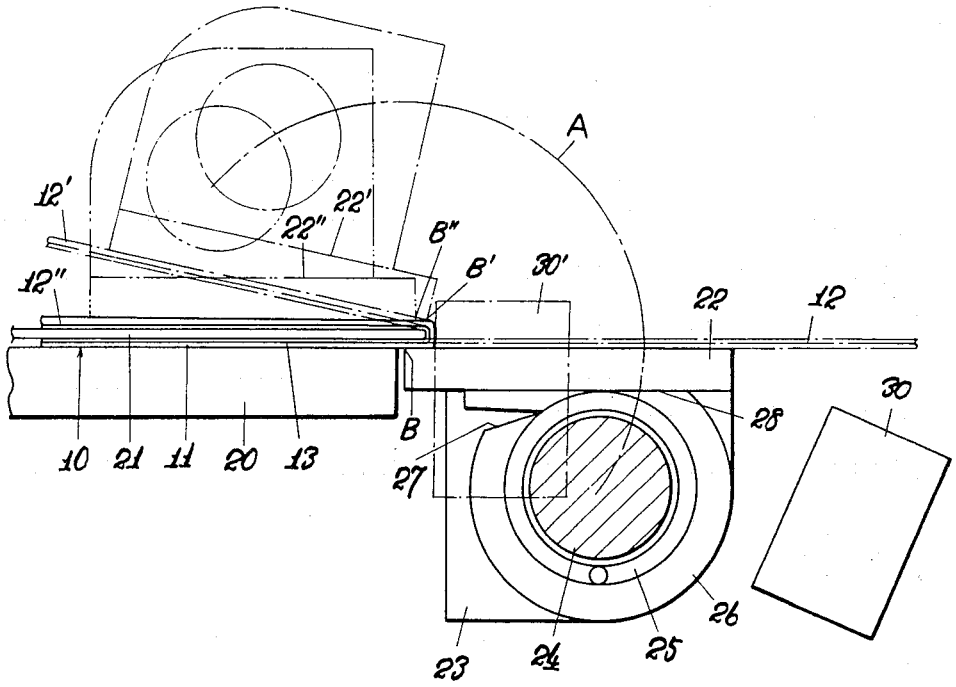
FIG. 3 illustrates the process of operation of one embodiment of the method according to the present invention.

In FIG. 3, a table 20 of a jacket forming device is shown. A folding insert 21 with its left end fitted to a rocking arm (not shown in the drawings) is provided, facing the upper surface of the table 20. This folding insert 21 swings up and down at a small angle with a designated timing. In this embodiment, a forward end of the folding insert 21 is protruded slightly from a front edge (right side edge) of the table 20. A folding bar 22, with three bosses 23 (at both ends and at the central part) is loosely fitted to a pivot 24. This pivot 24 is moved about 180° counterclockwise and upwardly along an arcuate locus A. A spring 25 is wound round the pivot 24 and collars 26 are fixed at both sides of the spring 25. One end of the spring 25 is inserted in one of the collars 26 and the other end of the spring 25 is applied to the undersurface of the folding bar 22 so that the folding bar 22 is imparted with the counterclockwise revolving power by the elastic force of the spring 25. The collar 26 is cut off at right and left of its upper edge to form slanting surfaces 27, 28 so that the folding bar 22 is allowed to move slightly against the spring 25 by the left slanting surface 27 and is fixed in a horizontal posture by the right slanting surface 28 as shown in the drawings. A heater bar 30 encloses therein electric heat wires. This bar 30 draws near a forward end of the folding insert 21 as occasion demands.

One embodiment of the present invention utilizes the table 20, the folding insert 21, the folding bar 22, and the heater bar 30. When the folding insert 21 moves away from the table 20, the jacket material 10 stuck with the liner 11 is fed from the front side of the table 20 and the left end of the jacket material 10 is held by a stop pin (not shown in the drawings) so as to determine its position. Immediately after the jacket material 10 is fed, the folding insert 21 lowers and presses the left half portion 13 of the jacket material 10. Then, the folding bar 22 approaches the table 20 and makes its front upper end surface B get into the underside of the forward end of the folding insert 21, whereupon the undersurface at the central part of the jacket material 10 is pressed against the projecting part of the folding insert 21 by the revolving power of the folding bar 22. At this time, the pivot 24 of the folding bar 22 moves about 180° upwardly and rearwardly, drawing the arcuate locus A, as sown in FIG. 3. At the initial stage of this movement, the folding bar 22 revolves counterclockwise against the force of the spring 25. By this revolution, the undersurface of the folding bar 22 moves away slightly from the right slanting surface 28 of the collar 26 toward the left slanting surface 27 or inclines slightly from the horizontal position. Thus, the folding bar 22 presses the central part of the jacket material 10 with its upper surface close to the end surface B against the lower end of the projecting portion of the folding insert 21 by the elastic force of the spring 25, as it is inclining. With the movement of the pivot 24 drawing the arcuate locus A, the inclining folding bar 22 rises as it is taking the upright posture, whereupon the folding bar 22 rubs the central part of the jacket material 10 with its upper surface close to the end surface B and bends up the right half of the jacket material 10 by 90°. When the folding bar 22 rises further the end surface B of the folding bar 22 reaches the upper end of the projecting portion of the folding insert 21, the folding bar 22 begins to turn with the end surface B as the center, in proportion to the movement of the pivot 24 along the arcuate locus A, and advances leftwardly as it is taking a reverse posture 22'.

By the reversal of the folding bar 22 the right half portion 12 of the jacket material 10 is folded largely as shown by the chain line 12' and the folded corner is rubbed with the end surface B' and contacts tightly the projecting portion of the folding insert 21. Before this time, namely, before the folding angle of the jacket material 10 becomes 180°, the heater bar 30 advances and presses the folded corner of the jacket material 10 against the forward end of the folding insert 21 to form the folded corner in a ⊐ shape, as shown by the chain line 30'. The folding bar 22 continues to advance and revolve as it is rubbing the jacket material 10 by the end surface B" and, when it revolved 180° as shown by the chain line 22", it presses the right half portion 12" of the jacket material 10 against the upper surface of the folding insert 21. At this time, formation of the jacket material 10 by heating has already finished and the heater bar 30 retreats. The folding bar 22" retreats to its original position and the table 20 is revolved 90° to shift back to the flap folding position for the next operation.

In the conventional method of folding jacket material 10, a forward end of the folding bar 22 is positioned at the end surface of the table 20 and the folding bar 22 is simply moved in an arc. Therefore, loosening, warping, waving, swelling, etc. are liable to take place at the folded corner. As a heater bar 30 is applied to such folded corner, formation of the folded corner is inaccurate, resulting in poor external shape and poor dimensional precision of the jacket material 10.

In this embodiment, however, a forward end of the folding insert 21 is projected from the front edge of the table 20 and the jacket material 10 is folded 180° as it is being rubbed by the folding bar 22. Therefore, jacket material 10 is entirely free from trouble at the folded corner, such as loosening, warping, waving and swelling which often take place in the conventional method of folding. Moreover, since the jacket material 10 is rubbed by the folding bar 22 while it is heated by a heater bar 30 which is applied earlier, the folded corner can be formed exactly in a ⊐ shape, with resultant production of jackets of high precision in external shape and dimensions.

The present invention further provides an apparatus which is most suitable for carrying out the method of folding 180° jacket material 10 while rubbing it. An embodiment of the apparatus according to the present invention is explained below with reference to FIGS. 4–6.

In the drawings, a table 20 of a jacket forming device as shown. A forward end of the folding insert 21 is projected slightly from the front edge of the table 20. The jacket material 10 stuck with a liner is supplied onto the table 20 and the left half portion 13 of the jacket material 10 is pressed by the folding insert 21. Three bosses 23, provided at both ends and at the central part of the folding bar 22, are loosely fitted to the pivot 24, around which spring 25 is wound with its one end inserted in one of the collars 26 and the other end imparting to the folding bar 22 a counterclockwise revolving force. The collar 26 has slant surfaces 27, 28 at right and left of its upper edge. The folding bar 22 is allowed some "play" of the angle by the slant surface 27 and is kept in a horizontal posture by the other slant surface 28. A heater bar 30 is adapted to approach the projecting end of the folding insert 21. The above structure is explained in regard to the embodiment of the method according to the present invention.

Figure 4:
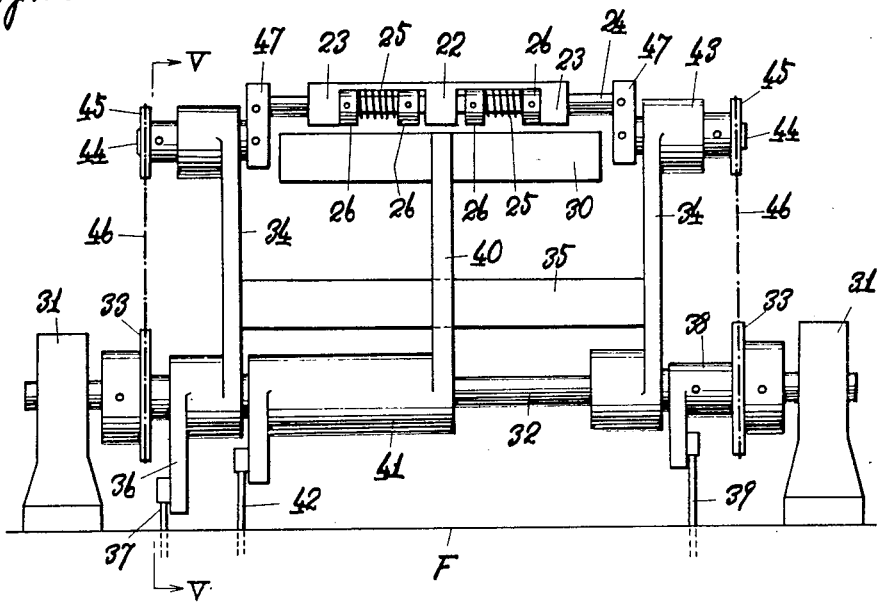
FIG. 4 is a front view showing one embodiment of the apparatus according to the present invention.
Figure 5:
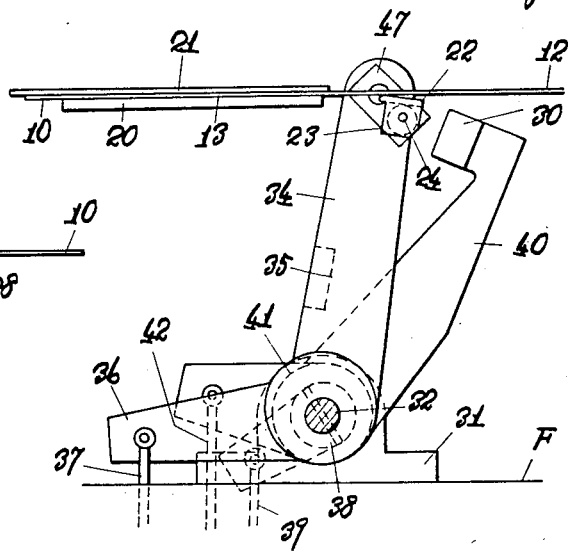
FIG. 5 is a cross section, taken along the line V—V in FIG. 4.

Bearings 31 with some distance therebetween are fitted to a frame F located below the front edge of the table 20. A long lower axis 32 is inserted rotatably in this bearing 31. To both end portions of the lower axis 32, chain wheels 33 are fixed and bosses of arms 34 are fitted loosely. Two arms 34 are connected to each other by a stay 35. A link 37 is connected to a projecting portion 36 from the boss of one of the arms 34 and another link 39 is connected to a projecting portion of a pipe 38 fixed to the lower axis 32, adjoining the boss of the other arm 34. A supporting rod 40 is interposed between arms 34. The central part of the heater bar 30 is fixed to the top end of the supporting rod 40. A cylindrical boss 41, provided at the lower end of the supporting rod 40, is fitted loosely to the lower axis 32. A link 42 is connected to a projecting portion from the boss 41. Bearings 43 are provided at the upper end of the arms 34. Fixed to an outer end and an inner end of an upper axis 44 loosely fitted to the bearings 43 are a chain wheel 45 and a connecting piece 47 respectively. Chains 46 are put on these chain wheels 45 and chain wheels are put on the lower axis 32. The connecting pieces 47 are directed frontwardly and downwardly to connect both ends of the pivot 24. In order to facilitate understanding of the drawing, connecting pieces 47 in FIG. 4 are shown in their uppermost position.

Figure 6:
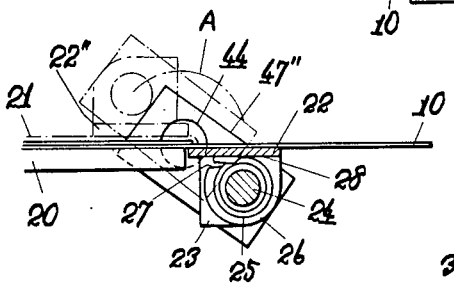
FIG. 6 is a cross section, on an enlarged scale, showing the operation of the folding bar.

An embodiment of the apparatus according to the present invention is structured as mentioned above. At first, the folding bar 22 and the heater bar 30 are standing by ready in the position shown in FIG. 5. When the jacket material 10 is fed to the upper surface of the table 20 and its left half portion 13 is pressed by the folding insert 21, the link 37 is lowered and arms 34 are put in an upright position. As shown in FIG. 6, the folding bar 22 approaches the table 20 and its front and upper end surface moves to the underside of the projecting end of the folding insert 21, whereupon the central part of the jacket material 10 is pressed against the projecting portion of the flding bar 22. Then, the lower axis 32 is revolved counterclockwise by lowering the link 39. The upper axes 44 are revolved by two sets of chain wheels 33, 45 and the chains 46, whereupon connecting pieces 47 fixed to the upper axis 44, revolve counterclockwise and rise from the frontward and downward posture, taking a rearward and upward posture as shown by the chain line 47″ in FIG. 6. Thus, the pivot 24 connected to the connecting piece 47 moves along the arcuate locus A with the upper axis 44 as its center, as shown in FIG. 6. When the pivot 24 moves along the arcuate locus A, the folding bar 22 then folds the jacket material 10 as it is rubbing the jacket material 10. The following reversal of the folding bar 22 folds the jacket material 180°. Before the folding angle becomes 180°, the link 42 is lowered to make the arm 40 get up so as to apply the heater bar 30 to the folded corner and to form it in a ⊐ shape. Then, the links 42, 39, and 37 are lowered to return the folding bar 22 and the heater bar 30 to their respective original positions.

The foregoing disclosure describes one embodiment of the apparatus of the present invention. This invention, however, is not limited to this embodiment and can be changed in design within the gist of the present invention. For example, the chain wheels 33, 45 and the chain 46 may be replaced with gears and a timing belt. Also, the line 37 which moves the arm 34, the link 42 which moves the supporting rod 40, and the link 39 which rocks the lower axis 32 are operated by cams or pressure cylinders (both of which are not shown in the drawings) but it is possible to dispense with these links and to operate the arm 34, the supporting rod 40, and the lower axis 32 directly by cams or by piston rods of pressure cylinders. As the forward end of the folding insert 21 is projectd from the front edge of the table 20 of the jacket forming device and the central part of the jacket material 10 is folded 180° in tight contact with the folding insert 21 as it is being rubbed by the folding bar 22, the folded corner is entirely free from loosening, warping, waving, swelling, etc. Moreover, as the jacket material 10 is rubbed by the folding bar 22 while it is being heated by the heater bar 30 which is applied to the folded corner before the folding angle becomes 180°, the folded corner can be shaped in a ⊐ shape accurately, with resultant production of jackets with high precision in dimensions and external shapes formed at high efficiency.

The apparatus of the present invention is provided with the folding bar 22 which folds jacket material 10 180° in tight contact with the folding insert 21 as it is rubbing the jacket material 10. Springs 25 impart revolving power to the folding bar 22 and collars 26 maintain the folding bar 22 in a horizontal posture, both of which are fitted to the pivot 24. Chain wheels 33 are fixed to both end portions of the long lower axis 32 and are provided below the front edge of the table 20. The bosses of two arms 34 are loosely fitted to both end portions. The bosses of the supporting rod 40 are fitted with the heater bar 30 and are loosely fitted to the lower axis 32. The chain wheels 45 are fixed to the short upper axis 44 and are loosely fitted to the bearing 43 at the upper end of the arm 34. The chains put on between said chain 46 are wheels 45 and the chain wheels 33 above the lower axis 32. The pivot 24 of the folding bar 22 is connected to the connecting piece 47 fixed to the inner end of the upper axis 44. With this arrangement, the action of the folding bar 22 to fold the central part of jacket material 10 at 180° while rubbing it and the action of applying the heater bar 30 to the folded corner before the folding angle of the jacket material 10 becomes 180° can be done smoothly with a simple motion.

What is claimed is:

1. An apparatus for folding a jacket material, comprising:

(a) an upper shaft and a parallel lower shaft, each having opposite ends;

(b) arm means, mounted on the opposite ends of the upper and lower shafts, for connecting the shafts together;

(c) table means, arranged adjacent to the upper shaft, for supporting the jacket material;

(d) bar means, mounted on the upper shaft, for folding the jacket material over substantially 180°, forming a folded corner at one end of the jacket material, and rubbing the jacket material;

(e) insertion means, provided above the table means, for placing a liner into the folded jacket material;

(f) a supporting rod having two ends with one end being mounted on the lower shaft; and (g) heater bar means, mounted on the end of the supporting rod opposite from the one end which is mounted on the lower shaft, for reciprocating in an arc about the lower shaft into and out of heat-pressing contact with the folded corner of the jacket material after the folded corner is formed and before the jacket material is rubbed by the folding bar means.

2. The apparatus, according to claim 1, further comprising:

(h) spring means, mounted around the upper shaft, for moving the folding bar means in an arc of substantially 180°; and (i) collar means, mounted on the upper shaft, for maintaining the folding bar means in a horizontal position against arcuate movement caused by the spring means.

3. The apparatus, according to claim 2, further comprising:

(j) first link means, operatively connected to the arm means, for rocking the arm means about the lower shaft; and (k) second link means, operatively connected to the supporting rod, for rocking the supporting rod about the lower shaft.

* * * * *